US005640148A

United States Patent [19]

Lewis et al.

[11] Patent Number: 5,640,148

[45] Date of Patent: Jun. 17, 1997

[54] DUAL ACTIVATION ALARM SYSTEM

[75] Inventors: R. David Lewis, Auburn; Robert E. Gray, Lawrenceville; Bruce A. Hefner, Conyers; Paul D. Hiltman, Atlanta, all of Ga.

[73] Assignee: International Safety Instruments, Inc., Lawrenceville, Ga.

[21] Appl. No.: 592,799

[22] Filed: Jan. 26, 1996

[51] Int. Cl.[6] ..... G08B 23/00

[52] U.S. Cl. ..... 340/573; 340/632; 200/61.74

[58] Field of Search ..... 340/517, 521, 340/573, 632; 200/51.09, 61.74; 128/204.23, 205.22; 116/67 R; 2/2

[56] References Cited

U.S. PATENT DOCUMENTS

| | | | |
|---|---|---|---|
| 4,914,422 | 4/1990 | Rosenfield et al. | 340/573 |
| 5,157,378 | 10/1992 | Stumberg et al. | 340/521 |
| 5,317,305 | 5/1994 | Campman | 340/573 |
| 5,541,579 | 7/1996 | Kiernan | 340/573 |

*Primary Examiner*—Jeffery Hofsass
*Assistant Examiner*—Mark S. Rushing
*Attorney, Agent, or Firm*—James B. Middleton

[57] ABSTRACT

A holder for a personal alert safety system (PASS) has a bracket to receive the PASS, and a housing connected to the bracket. An additional activation switch is installed in the PASS, the additional switch being magnetically operable. The housing is connected to the air line of a self contained breathing apparatus (SCBA). A piston or diaphragm is urged in one direction by air pressure, and is urged in the opposite direction by a spring in the absence of air under pressure. When the piston is moved in the one direction, a magnet is disposed adjacent to the additional switch, and when the piston is moved in the opposite direction by the spring, the magnet is removed from adjacent to the additional switch so the PASS is automatically activated by the presence of air pressure in an activated SCBA. The PASS can be used without the SCBA and can be activated manually as is conventional, either attached to or removed from the SCBA.

6 Claims, 1 Drawing Sheet

DUAL ACTIVATION ALARM SYSTEM

BACKGROUND OF THE INVENTION

1. Field of the Invention

This invention relates generally to personal alarm systems, and is more particularly concerned with an alarm device capable of dual modes of activation.

2. Discussion of the Prior Art

Alarm systems are currently utilized by people who work in hazardous environments. The usual alarm is intended to notify other people in the event one person is trapped or injured. The device commonly used is referred to as a personal alert safety system, or PASS. The PASS must be initially activated, then it monitors motion of the wearer. If there is no motion for a period of time (generally around 25 seconds) the PASS emits an audible, pre-alert signal. If the wearer fails to reset the PASS when the pre-alert signal is emitted, a very loud alarm signal will be emitted. The alarm signal will inform others in the area that someone may be unconscious, or otherwise in need of immediate assistance. The typical PASS is also capable of being manually triggered, so a person who is conscious, and is aware that he needs immediate assistance, can trigger the alarm signal.

PASS devices are mandated for all fire fighters due to the safety features offered. A problem arises, however, in that a fire fighter may forget the initial activation required for the PASS device to be operable. Without this initial activation, the PASS will not sense a lack of motion.

To assure that a person's PASS is activated, the activation needs to be automatic. This has been attempted in the situation in which the wearer is using a self contained breathing apparatus (SCBA). A pressure switch hag been provided so that, when the SCBA is turned on the supply air to the wearer, the air pressure will close the pressure switch to activate the PASS. While this system is effective in one situation, the altered PASS cannot be used without an SCBA, As a result, the average firefighter must have two different PASS's: one for use with an SCBA, and one for use without an SCBA. Thus, the prior art has not provided an adequate solution to the problem of activation of a PASS.

SUMMARY OF THE INVENTION

The present invention provides a PASS holder having means for receiving a PASS, and a housing. The PASS is provided With an additional activation switch connected in parallel with the existing activation switch, so the usual operation of the PASS is unchanged. The housing contains switch operating means for operating the additional switch in response to pressure from a breathing apparatus, or SCBA.

In the preferred embodiment or the invention, the additional activation switch is a magnetically operated switch in the casing of the PASS for operation by a magnetic field externally of the PASS. With this arrangement, the PASS can be used alone when toe wearer is not using an SCBA, and the operation of the PASS is unchanged. When the wearer is using an SCBA, however, the PASS will be inserted into a PASS holder that is connected to the SCBA. The PASS holder includes a magnet selectively disposable adjacent to the magnetically operated switch in the PASS. In one embodiment of the invention, a mechanical device carries the magnet, and the mechanical device is movable by the air pressure when the SCBA is activated for use by the wearer. The presence of air pressure moves the mechanical device to dispose the magnet adjacent to the magnetically operable switch.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
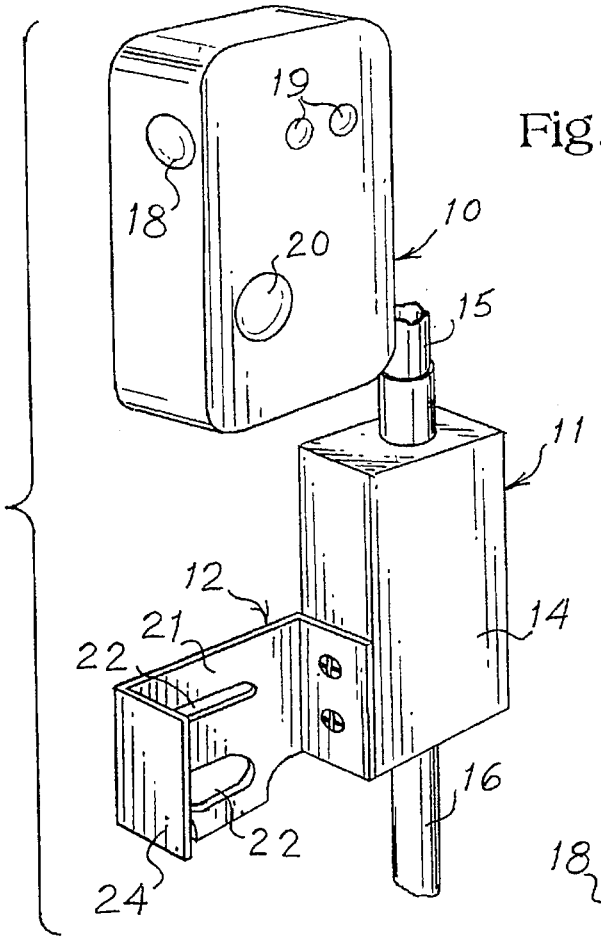
FIG. 1 is an exploded perspective view showing a PASS holder made in accordance with the present invention with a PASS exploded therefrom; and, FIG. 2 is a front elevational view of the device shown in FIG. 1, the device being partially in cross-section, with a schematic representation of an SCBA.

Referring now more particularly to the drawings, and to that embodiment of the invention here shown by way of illustration, FIG. 1 shows one type of conventional PASS 10 and a PASS holder 11 made in accordance with the present invention. The PASS 10 is receivable within a bracket 12, the bracket 12 being carried by a housing 14. The housing 14 includes conduits 15 and 16 so the PASS holder of the present invention can be connected into the air line of an SCBA.

The PASS shown in FIG. 1 has on-off buttons 18 on opposite sides thereof which, when depressed, close the contacts of a normally-open pushbutton switch adjacent to the buttons. While only one button 18 is shown in FIG. 1, those skilled in the art will understand that there is generally a similar button on the opposite side. One can therefore place one's thumb on one button 18, and a finger on the opposite button, and squeeze to activate the PASS. When the PASS activated, the lights 19 will be illuminated to indicate that status. Finally, there is a button 20 on the front face of the PASS 10 for manually triggering the alarm signal. Other forms of PASS devices have different means for on/off and manual alarm functions, but these do not affect the essence of the present invention.

Looking at the bracket 12 in more detail, it will be noticed that the bracket 12 has a width to receive the PASS 10 snugly therein. The back panel 21 may define holes, or slits, 22 therein to receive straps or the like so the holder can be attached to equipment as desired. The bracket 12 and housing 14 are designed so as to leave the on-off buttons 18 uncovered and readily accessible for manual operation when the PASS 10 is received within the bracket 12.

Figure 2:
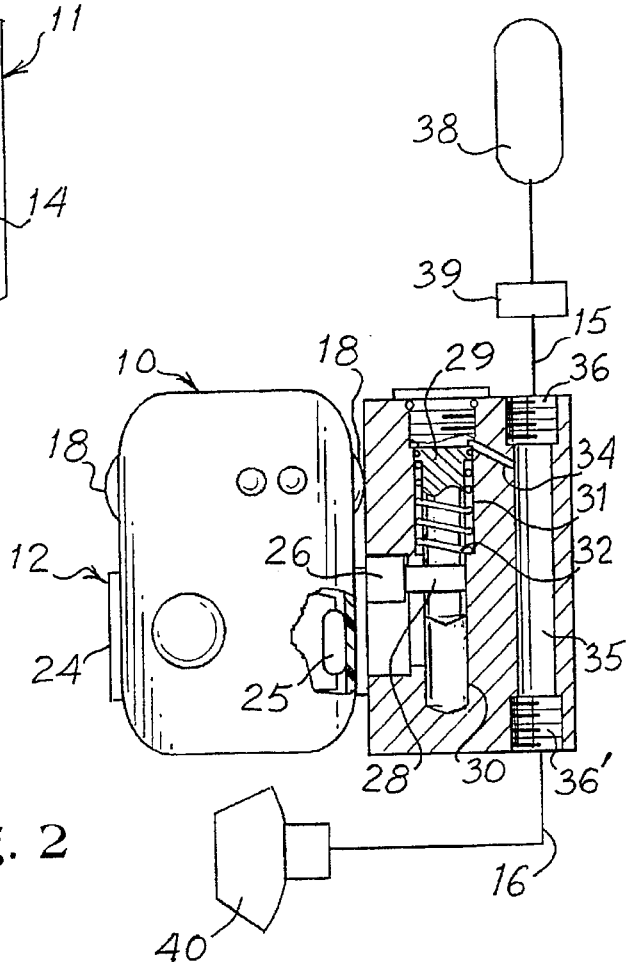

Attention is now directed to FIG. 2 of the drawings for a discussion of the PASS holder 11. It will be seen that the PASS 10 is positioned within the bracket 12; and, a portion of the PASS 10 is broken away to show a switch 25 within the PASS 10. The switch 25 is an additional activation switch for the PASS in accordance with the present invention. In the embodiment of the invention here presented, the switch 25 is a reed switch which will be closed in the presence of a magnetic field, and open in the absence of a magnetic field. Those skilled in the art will realize that other specific arrangements may be used, such as a Hall effect transistor or the like.

The housing 14 to which the bracket 12 is attached is shown in cross-section in FIG. 2 to illustrate the operation thereof. It can therefore be seen that there is a magnet 26 within the housing adjacent to the bracket 12. The magnet 26 is therefore located so that it can be disposed in an upward position as shown, and the magnet 26 is removed from the vicinity of the switch 25 so the switch 25 will be open. The magnet 26 can be moved to a downward position and it will be adjacent to the switch 25, so the switch 35 will be closed. The magnet may also move perpendicularly to the axis of the switch 25 to effect the on/off function.

In order to move the magnet 26 as desired, the magnet 26 is carried by an arm 28, the arm 28 being fixed to a piston 29. Thus, us the piston 29 is reciprocated within the housing 14, the magnet 26 will be reciprocated. It will of course be recognized that various forms of mechanical devices other than a piston may be used. A diaphragm or other known device may be utilized so long as the final motion is achieved.

The piston 29 is slidably received within a bore 30, the bore 30 including a counterbore 31 that receives a spring 32. The spring 32 acts between the bottom of the counterbore 31 and the head of the piston 29 to urge the piston 29 to its upper position as shown in the drawings. To urge the piston 29 down, there is a passage 34 that connects the space above the piston 29 with a bore 35. The bore 35 as here shown has threaded connectors 36 and 36' at each end for connecting hoses thereto. Thus, anytime there is high pressure in the bore 35, that pressure will be reflected through the passage 34 to urge the piston 29 down. When the piston 29 moves down, the magnet 26 will move into position to close the switch 25, thereby activating the PASS 10.

With the foregoing description in mind, it will be understood that the PASS holder 11 may be fixed to SCBA equipment. In FIG. 2 of the drawings the SCBA is represented by an air tank 38 connected to a primary pressure regulator 39, the regulator being connected to the bore 35 at the threaded connection 36. A hose 16 is also connected to the threaded connector 36', and this hose leads to the secondary regulator and mask 40. Thus, for the SCBA to be usable, air under pressure must be within the bore 35, and when air under pressure is in bore 35, the PASS will be activated.

In the event a firefighter is to be in an environment that does not require the SCBA, but does require the PASS, the PASS 10 can be easily removed from the bracket 12, and the PASS 10 operates as usual. The wearer must push the buttons 18 to activate the PASS. It will therefore be understood that one can use a single PASS, and the PASS is automatically activated when utilized with an SCBA, is usable manually while utilized with an SCBA but with the SCBA non-activated, and is usable without alteration without the SCBA.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

We claim:

1. A holder for a personal alert safety system in combination with a self contained breathing apparatus, said personal alert safety system including a switch for activating said personal alert safety system, said holder defining a bore therein for receiving air under pressure from said self contained breathing apparatus, an additional switch in said personal alert safety system for overriding said switch, said additional switch being magnetically operable, said holder including switch operating means for said additional switch responsive to air under pressure in said bore, said switch operating means including a magnet selectively disposable adjacent to said additional switch in said personal alert safety system.

2. A holder as claimed in claim 1, wherein said switch operating means comprises a mechanical device fixed to said magnet, said mechanical device being movable by said air under pressure.

3. A holder as claimed in claim 2, wherein said mechanical device comprises a piston received within a second bore, spring means for urging said piston in a first direction, an air passage connecting said second bore with said first bore so that air pressure in said bore is directed to said second bore for urging said piston in a second direction opposite from said first direction.

4. A holder as claimed in claim 3, said holder comprising a bracket for selectively receiving said personal alert safety system and a housing connected to said bracket, said additional switch in said personal alert safety system being located adjacent to said housing when said personal alert safety system is received within said bracket.

5. A holder as claimed in claim 4, wherein said magnet is fixed to said piston and movable therewith, and said air pressure in said bore moves said piston in said second direction to dispose said magnet adjacent to said additional switch.

6. A holder as claimed in claim 5, wherein said bore includes a first connector and a second connector, said first connector being connected to the primary regulator of said self contained breathing apparatus for receiving air under pressure from said self contained breathing apparatus, said second connector being connected to the secondary regulator of said self contained breathing apparatus for delivering air to the face mask of said self contained breathing apparatus.

* * * * *